US009079285B2

(12) United States Patent
Krämer et al.

(10) Patent No.: US 9,079,285 B2
(45) Date of Patent: Jul. 14, 2015

(54) POLISHING DEVICE WITH ROTARY TRANSMISSION LEADTHROUGH

(75) Inventors: Klaus Krämer, Dautphetal-Friedensdorf (DE); Ulf Börner, Marburg (DE); Gunter Schneider, Marburg (DE)

(73) Assignee: SCHEIDER GMBH & CO. KG, Fronhausen (DE)

( * ) Notice: Subject to any disclaimer, the term of this patent is extended or adjusted under 35 U.S.C. 154(b) by 494 days.

(21) Appl. No.: 13/428,115

(22) Filed: Mar. 23, 2012

(65) Prior Publication Data

US 2013/0072090 A1 Mar. 21, 2013

(30) Foreign Application Priority Data

Mar. 25, 2011 (DE) ..... 10 2011 015 225
Mar. 29, 2011 (DE) ..... 10 2011 015 458

(51) Int. Cl.
*B24B 13/00* (2006.01)
*B24B 13/02* (2006.01)
*B24B 57/02* (2006.01)

(52) U.S. Cl.
CPC ..... *B24B 13/00* (2013.01); *B24B 13/02* (2013.01); *B24B 57/02* (2013.01)

(58) Field of Classification Search
CPC ..... B24B 13/012; B24B 13/02; B24B 37/08; B24B 55/02
USPC ..... 451/41, 60, 259, 262, 269, 277, 451/285–291
See application file for complete search history.

(56) References Cited

U.S. PATENT DOCUMENTS

| | | | | |
|---|---|---|---|---|
| 4,593,495 | A * | 6/1986 | Kawakami et al. | 451/269 |
| 5,595,529 | A * | 1/1997 | Cesna et al. | 451/291 |
| 5,779,525 | A * | 7/1998 | Boller | 451/262 |
| 5,782,678 | A * | 7/1998 | Cesna et al. | 451/269 |
| 7,338,346 | B2 * | 3/2008 | Kuebler et al. | 451/5 |
| 7,422,510 | B2 * | 9/2008 | Schneider et al. | 451/5 |
| 8,574,035 | B2 * | 11/2013 | Schneider et al. | 451/259 |
| 2004/0176017 | A1 * | 9/2004 | Zelenski et al. | 451/41 |
| 2004/0224619 | A1 * | 11/2004 | Granziera et al. | 451/277 |
| 2008/0096478 | A1 * | 4/2008 | Belly et al. | 451/510 |
| 2010/0159809 | A1 * | 6/2010 | Schneider et al. | 451/42 |

FOREIGN PATENT DOCUMENTS

| | | | |
|---|---|---|---|
| DE | 103 14 625 | B3 | 10/2004 |
| DE | 10 2004 062 319 | B3 | 3/2006 |
| DE | 10 2007 040 395 | A1 | 3/2009 |
| DE | 10 2008 061 267 | A1 | 6/2010 |
| DE | 10 2009 036 981 | A1 | 2/2011 |
| EP | 1 473 116 | A1 | 11/2004 |

* cited by examiner

*Primary Examiner* — Maurina Rachuba
(74) *Attorney, Agent, or Firm* — Hudak, Shunk & Farine Co. LPA

(57) ABSTRACT

A polishing device for zone polishing of optical lenses with a tilting base part for direct or indirect holding of a polishing pad, wherein the base part for driving purposes is rotationally driven and connected to a spindle shaft, rotationally mounted, of a polishing spindle, and a rotary leadthrough is provided, by which the feeding of polishing compound in a polishing compound channel of the base part is assured, wherein the rotary leadthrough is directly or indirectly arranged on the spindle shaft and the base part can tilt relative to the rotary leadthrough. The rotary leadthrough stands in a flow connection with the base part via a flexible fluid connection.

7 Claims, 2 Drawing Sheets

POLISHING DEVICE WITH ROTARY TRANSMISSION LEADTHROUGH

FIELD OF THE INVENTION

The invention relates to a polishing device for zone polishing of optical lenses with a tilting base part for direct or indirect holding of a polishing pad, wherein the base part for driving purposes is rotationally driven and connected to a spindle axis, rotationally mounted in a spindle housing, of a polishing spindle, and a rotary leadthrough is provided, by means of which the feeding of polishing compound in a polishing compound channel of the base part is assured.

Moreover, the invention pertains to a polishing device for the polishing of optical lenses with a tiltable solid base part for direct or indirect holding or clamping of a polishing pad, wherein the base part has a spherical cap in order to be placed on a spherical head of a polishing spindle and the base part for purposes of a rotary drive is coupled or at least can be coupled by a connecting piece to a polishing spindle having a rotary axis D. In order to ensure a clamping seat, nonhard materials such as rubber cannot be used for the base part.

The invention also pertains to a method for zone polishing of aspherical lenses that are not rotationally symmetrical by using a polishing pad that can be tilted by a polishing spindle.

BACKGROUND OF THE INVENTION

In the making of an aspherical or non-rotationally symmetrical lens, such as lenses with toroidal surface or free-form surfaces, one generally uses tools and polishing heads that are smaller than the surface of the lens being machined, so-called zone polishing tools.

In zone machining, the tool or the polishing head is guided over the surface, while polishing compound is placed on the areas of the lens surface being machined that are not covered by the tool, which then works its way in between the polishing tool and the lens surface being machined, thereby improving the polishing performance. In order to adapt the polishing head to the shape of the surface being machined, this is mounted by a ball and socket joint and can be tilted. Moreover, the polishing head has an elastic backing layer for the polishing foil, so that a local deformation of the polishing head is possible for an adapting to the shape.

Such a polishing tool is known from DE 10 2004 062 319 B3. This describes a polishing device for optical lenses with a seat having an axis of rotation X for arrangement on a polishing machine and a collar arranged on the seat for the rotational driving of a tool holder or polishing head holder arranged on the collar, wherein the tool holder is guided by and tilted by a guide piston, coaxially mounted in the seat and able to move in the direction of the rotational axis X.

Moreover, a polishing device for the polishing of optical lenses is known from DE 10 2008 061 267 A1. The polishing device has a tilting base piece for direct or indirect holding of a polishing pad, wherein the base piece is connected to a polishing spindle for purposes of rotary drive and a rotary leadthrough is provided for purposes of feeding of polishing compound, being arranged at least partly opposite the polishing spindle in relation to the base piece. The leadthrough is supplied from the outside by means of a hose connection via a stationary reservoir of polishing compound, the hoses being attached to the nonturning part of the leadthrough, even though this is likewise tilted during the process.

A polishing device is known from DE 10 2009 036 981 A1 for the polishing of optical lenses, with a tilting base part, for the direct or indirect holding of a polishing pad, wherein the base piece has a spherical cap for placement on a spherical head of a polishing spindle and the base piece is coupled for rotary drive to a spindle shaft of a polishing spindle by a connection piece, wherein the spherical cap is designed as a separate bearing part and it is arranged in the base piece.

SUMMARY OF THE INVENTION

The basic problem of the invention is to provide a polishing device for the zone machining of surfaces that are not rotationally symmetrical, having improved polishing properties in terms of mobility and long service life.

The problem is solved according to the invention by a polishing device for zone polishing of optical lenses comprising a tilting base part for direct or indirect holding of a polishing pad, wherein the base part for driving purposes is joined to and rotationally driven by a rotary mounted spindle shaft of a polishing spindle and a rotary leadthrough is provided, by which the feeding of polishing compound to a polishing compound channel of the base part is assured, wherein the rotary leadthrough is directly or indirectly arranged on the spindle shaft and the base part can tilt relative to the rotary leadthrough, while the rotary leadthrough stands in flow connection with the base part via a flexible fluid connection; as well as a polishing device for polishing of optical lenses comprising a tilting base part for direct or indirect holding of a polishing pad, wherein the base part for mounting on a spherical head of a polishing spindle has a spherical cap and the base part is coupled via a connecting part to a spindle shaft of a polishing spindle for purposes of rotary drive, wherein the spherical cap is configured as a separate bearing part and is arranged in the base part, wherein the bearing part is made from a different material than the base part; and a method for zone polishing of aspherical, non-rotationally symmetrical lenses, comprising the steps of using a polishing pad that can tilt on a spindle shaft of a polishing spindle, and supplying polishing compound during the polishing via a rotary leadthrough arranged stationary on the spindle shaft and taken by a fluid connection to the polishing pad.

With the arrangement of the rotary leadthrough on the spindle housing, the coupling of the hose connection to the rotary leadthrough from the outside, i.e., a largely stationary hose connection to the base part that is tilting and rotating on the spherical head during the polishing process, is hindered. According to the invention, all that is needed is a hose connection connected to the part of the rotary leadthrough that is likewise rotating. The hose connection turns along with the spindle and the rotating part of the rotary leadthrough. Since only the flexible hose connection is coupled to the base part, the base part is only slightly influenced in its tilting movement. The mobility of the base part on the spherical head for adapting to the position dictated by the rotating work piece is considerably improved.

These benefits are also achieved by the method of the invention. During the polishing, polishing compound is supplied from the outside via a rotary leadthrough arranged stationary on the spindle shaft. The polishing compound is taken via a flexible fluid connection from the rotary leadthrough to the base part and to the polishing pad arranged on top of it.

Likewise, the use of a separate bearing part or a separate spherical cap of a different material allows an even better mobility on the spherical head and thus the mobility improved by the rotary leadthrough of the invention for the base part as a whole. This, especially in the context of using different materials. The material for the bearing part can thus be chosen solely for its sliding properties, regardless of the desired material properties for the base part. The latter is in direct contact with the very abrasive polishing suspension and furthermore it is under load cycles in the region of the holder geometry due to the tilting up and down of the polishing pad. Thus, ah enhanced wear resistance can be guaranteed with the free choice of material.

The slidable material to be used for the bearing part, with sufficiently good elasticity, also enables an easy mounting when placing on or removing from the spherical head. With enhanced elasticity, an improved stretching of the spherical cap is assured when inserting or pulling off the spherical head.

It can also be advantageous for the base part to be made as a composite part with the bearing part or the spherical cap, wherein the bearing part is integrated or at least can be integrated in the base part. With a composite material, favorable material pairings can be made for the base part on the one hand and the spherical cap or the bearing part, on the other. The material of the bearing part can be chosen for optimal sliding movements on the spherical head, while the base part can be formed with a view to the constant changing of the polishing pad, on the one hand, and wear resistant to the aggressive polishing compound, on the other.

Basically, for the purpose of forming a part made of composite material, an additional connection element can also be provided between the bearing part and the base part. In this case, the bearing part and the base part could be made from the same material. Basically, only different material properties to form a composite material, such as different cross-linked plastics or different hardened metals.

Moreover, it can be advantageous here to use at least one of the materials: metal, plastic, or ceramic, for the base part and for the bearing part, so that material combinations with the desired properties are possible. Assuming the use of materials for the base and bearing, part assembly with different mechanical properties, different material pairings are provided as the composite material. Plastic such as Teflon affords very good sliding properties, while ceramic and metal are very wear-resistant. The latter guarantees a long life for the base part, which is subjected to many alternating cycles of the tilting polishing head. The shape stability of the base part is also assured when using ceramic or metal.

It can also be advantageous in terms of enhanced mobility for the fluid connection to have a first connector to the base part and a second connector to the rotary leadthrough, while the first connector is staggered relative to the second connector in relation to a circumferential direction of the spindle shaft. Thus, the fluid connection can be configured of sufficient length so that there is the least possible influence on the tilting movement of the base part or the polishing head, given the available flexibility of the fluid connection.

For this, it is advantageous for the first connector to be arranged opposite the second connector in regard to the circumferential direction of the spindle shaft. In this way, the two connectors are at maximum distance from each other, ensuring a maximum length of the fluid connection. Distances between the connectors in the axial direction are not considered in this case.

Alternatively, it can be advantageous to provide at least two fluid connections, each with a connector, while the connectors are distributed symmetrically on the base part in relation to the circumferential direction of the spindle shaft. With the symmetrical connection, the resulting influences on the tilting movement of the base part are likewise-symmetrical or equalized, so that an optimal polishing result is achieved.

BRIEF DESCRIPTION OF THE DRAWINGS

Further benefits and details of the invention are explained in the patent claims and in the specification and represented in FIGS. 1 and 2, wherein:

DETAILED DESCRIPTION OF THE INVENTION

Figure 1:
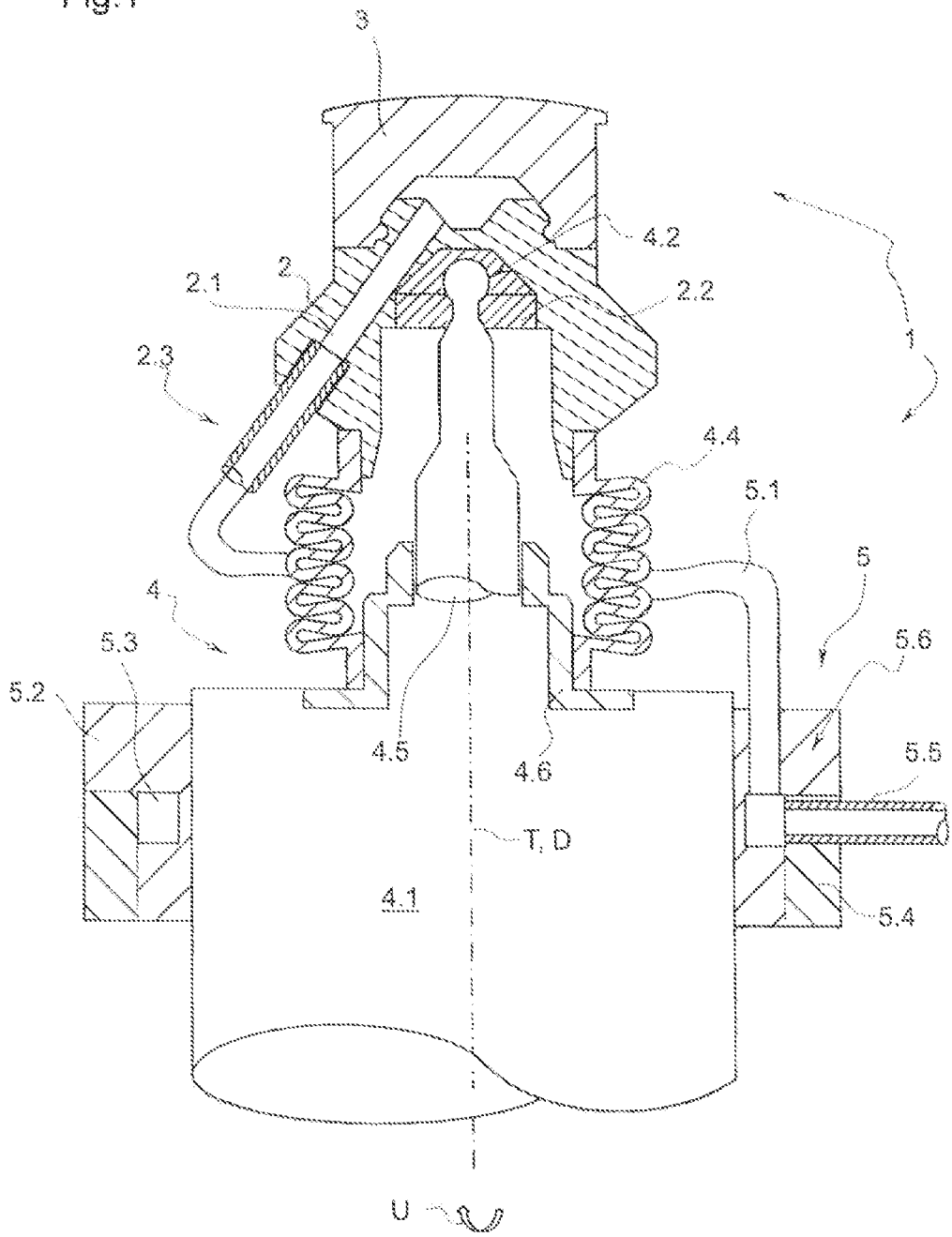
FIG. 1 is a cross-sectional view of one embodiment of a polishing device.

A polishing device 1 shown in FIG. 1 consists of a polishing spindle 4 with a spindle shaft 4.1 that can turn in the circumferential direction U, at whose front end there is provided a base part 2 with a removably clamped polishing pad 3. The base part 2 is joined to the spindle shaft 4.1 in rotary connection by a connection part fashioned as a bellows 4.4.

The polishing spindle 4 has a piston 4.5 mounted coaxially to the axis of rotation D, at whose end face there is provided a spherical head 4.2 as part of a ball and socket joint to hold the base part 2 and allow it to tilt. The piston 4.5 can move axially in the direction of an axis of translation T and is guided in a cylinder 4.6 for this purpose.

The spindle shaft 4.1 carries a rotary leadthrough 5 for polishing compound, which stands in flow connection via a second connector 5.6 and a fluid connection 5.1 with a first connector 2.3 of the base part 2 and a channel 2.1 for polishing compound, connected to this. The two connectors 2.3, 5.6 lie on opposite sides of the base, part or the spindle, so that the flexibility of the fluid connection 5.1 in the form of a hose is utilized. The rotary leadthrough 5 is essentially formed from a base body 5.2 with an annular channel 5.3, which rotates with the spindle shaft 4.1. On the base body 5.2 sits a turning ring 5.4 that can turn relative to the base body 5.2, which is supplied with polishing compound via a stationary feed line 5.5. The turning ring 5.4 does not execute the rotational movement of the spindle shaft 4.1.

The base body 5.2 is joined by the flexible fluid connection 5.1 to the polishing compound channel 2.1 of the bases part 2. Thus, the tilting movement essential for such a zone polishing tool is practically uninfluenced. Only the flexible fluid connection 5.1 could justify an influence.

In order to ensure a tilting movement with fewest possible losses, the bases part 2 is configured as a composite part. For this, the base part 2 has a spherical cap 2.2 made of plastic as another part of the ball and socket joint to receive the spherical head 4.2. The spherical cap 2.2 is secured inside the base part 2 made of aluminum.

The base part 2 made of aluminum is thus sufficiently resistant to wear, given the very aggressive polishing compound on the one hand and the repeated switching of polishing pads on the other.

Figure 2:
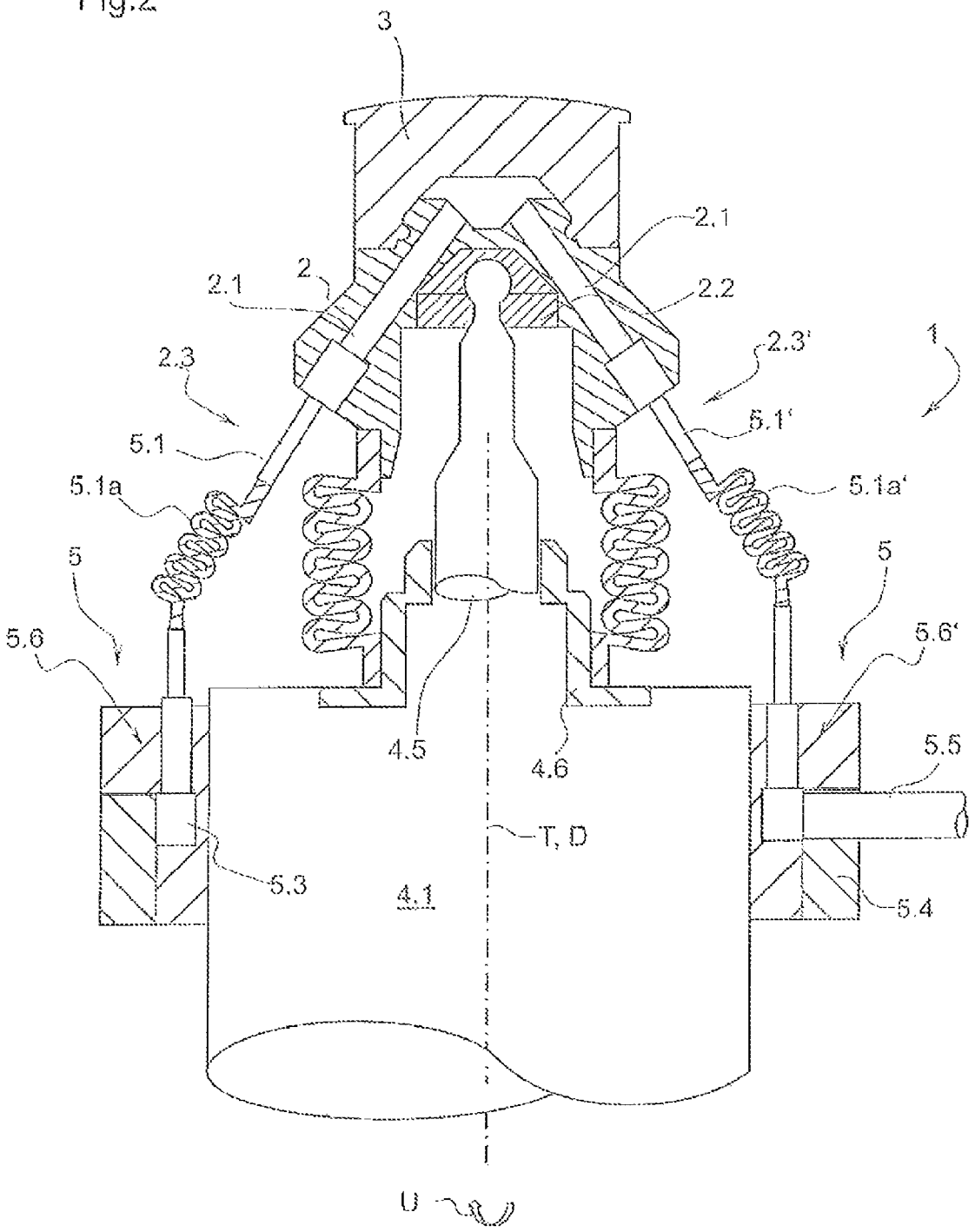
FIG. 2 is a cross-sectional view of an additional embodiment of a polishing device.

Per FIG. 2, a second fluid connection 5.1' is provided. The fluid connection 5.1, 5.1' has a meandering conduit 5.1*a*, 5.1*a*' of enhanced flexibility, while the respective connector 2.3, 2.3', 5.6, 5.6' is arranged on the same side of the base part 2 or the spindle shaft 4.1. The forces of the fluid connection 5.1, 5.1' acting on the base part 2 via the first connector 2.3, 2.3" are thus equalized with regard to the tilting movement of the base part 2.

LIST OF REFERENCE NUMBERS

1 polishing device
2 base part
2.1 channel for polishing compound
2.2 spherical cap, bearing part
2.3 first connector
2.3' first connector
3 polishing pad
4 polishing spindle

4.1 spindle shaft
4.2 spherical head, ball and socket joint
4.4 connection part, bellows
4.5 piston
4.6 cylinder
5 rotary leadthrough
5.1 fluid connection
5.1' fluid connection
5.1*a* meandering conduit
5.1*a*' meandering conduit
5.2 base body
5.3 ring channel
5.4 turning ring
5.5 feed line
5.6 second connector
5.6' second connector
D axis of rotation
T axis of translation
U circumferential direction

What is claimed is:

1. A polishing device for zone polishing of optical lenses, comprising: a tilting base part for direct or indirect holding of a polishing pad, wherein the base part for driving purposes is joined to and rotationally driven by a rotary mounted spindle shaft of a polishing spindle and a rotary leadthrough is provided, by which the feeding of polishing compound to a polishing compound channel of the base part is assured, wherein the rotary leadthrough is directly or indirectly arranged on the spindle shaft and the base part can tilt relative to the rotary leadthrough, while the rotary leadthrough stands in flow connection with the base part via a flexible fluid connection, wherein the rotary leadthrough includes a base body that is rotatable with the spindle shaft and a turning ring that can turn relative to the base body but does not execute the rotational movement of the spindle shaft.

2. The polishing device according to claim 1, wherein the fluid connection has a first connector on the base part and a second connector on the rotary leadthrough, and the first connector is staggered relative to the second connector in relation to a circumferential direction U of the spindle shaft.

3. The polishing device according to claim 2, wherein the first connector is arranged opposite the second connector in relation to the circumferential direction of the spindle shaft.

4. The polishing device according to claim 1, wherein at least two fluid connections are provided, each with a connector on the base part, and the connectors are arranged symmetrically distributed on the base part in relation to the circumferential direction U of the spindle shaft.

5. The polishing device according to claim 3, wherein at least two fluid connections are provided, each with a connector on the base part, and the connectors are arranged symmetrically distributed on the base part in relation to the circumferential direction U of the spindle shaft.

6. The polishing device according to claim 1, wherein the base body includes an annular channel for polishing compound, and wherein the flexible fluid connection is in fluid communication with the annular channel.

7. The polishing device according to claim 6, wherein a stationary feed line is connected to the turning ring, wherein the polishing compound is supplied to the annular channel through the stationary feed line.

* * * * *

UNITED STATES PATENT AND TRADEMARK OFFICE

CERTIFICATE OF CORRECTION

PATENT NO. : 9,079,285 B2
APPLICATION NO. : 13/428115
DATED : July 14, 2015
INVENTOR(S) : Klaus Krämer et al.

It is certified that error appears in the above-identified patent and that said Letters Patent is hereby corrected as shown below:

ON THE TITLE PAGE

In the Assignee, please replace "SCHEIDER GMBH & CO. KG" with -- SCHNEIDER GMBH & CO. KG --

Signed and Sealed this
Tenth Day of November, 2015

Michelle K. Lee

Michelle K. Lee
*Director of the United States Patent and Trademark Office*